US006163907A

United States Patent [19]

Larson

[11] Patent Number: 6,163,907

[45] Date of Patent: Dec. 26, 2000

[54] REMOVABLE MATTRESS TOP ASSEMBLY

[76] Inventor: Lynn D. Larson, 5410 NW. 44th St., Lincoln, Nebr. 68524

[21] Appl. No.: 09/054,993

[22] Filed: Apr. 3, 1998

[51] Int. Cl.[7] ..... A47C 17/00

[52] U.S. Cl. ..... 5/691; 5/500; 5/700

[58] Field of Search ..... 5/690, 691, 495, 5/497, 499, 500, 502, 421, 700, 737, 903

[56] References Cited

U.S. PATENT DOCUMENTS

| | | | |
|---|---|---|---|
| 773,138 | 10/1904 | Finchum | 5/421 X |
| 1,892,913 | 1/1933 | Timm | 5/737 X |
| 2,201,424 | 5/1940 | Berger | 5/691 X |
| 2,610,336 | 9/1952 | Schworm, Jr. | 5/699 X |
| 4,162,393 | 7/1979 | Balboni | 5/421 X |
| 4,388,738 | 6/1983 | Wagner | 5/738 X |
| 5,428,852 | 7/1995 | Tenuta et al. | 5/448 |
| 5,835,983 | 10/1998 | McMahen et al. | 5/421 X |

*Primary Examiner*—Terry Lee Melius
*Assistant Examiner*—James M Hewitt
*Attorney, Agent, or Firm*—Zarley, McKee, Thomte, Voorhees & Sease; Dennis L. Thomte

[57] ABSTRACT

A mattress top assembly for a mattress includes a pad filled with cushioning material and a plurality of connector straps attached along the head, foot, arid side edges of the pad and removably connected to the side wall of the mattress. The mattress includes one part of a cooperable fastener generally midway between top and bottom surfaces, on the side walls of the mattress, for detachable connection of each of the straps thereto.

7 Claims, 3 Drawing Sheets

REMOVABLE MATTRESS TOP ASSEMBLY

TECHNICAL FIELD

The present invention relates generally to bed mattresses, and more particularly to a mattress top assembly for a mattress, which may be removed and attached to other mattresses or to the inverted face of a mattress.

BACKGROUND OF THE INVENTION

A conventional bed assembly includes a bed frame, support springs, and a mattress. Most mattresses are formed in such a manner that they can be reversed and/or inverted, in order to counteract mattress sagging from continued weight of users in a single position.

Mattress tops have been used in the prior art to extend the useful life of a mattress. The mattress top is usually a relatively thin, but cushioned pad, coextensive with the length and width of the mattress and located on the upper surface of the mattress. The mattress top thereby provides additional cushioning on a mattress, while simultaneously protecting the mattress from soiling.

Prior art mattress tops are commonly attached on either the upper or lower surface of the mattress, using hook and loop fasteners, zippers, buttons and the like. These fasteners must be provided on both sides of the mattress so that the mattress top may be attached or reattached after inverting the mattress.

A recent patent on a mattress top assembly, U.S. Pat. No. 5,428,852, provides a strap on the mattress with a slidable buckle, permitting attachment of a mattress top to either the upper or lower surface of the mattress.

In view of the advantageous characteristics of mattress tops, it would be desirable to be able to provide an improved mattress top assembly which would be attachable to a variety of mattresses, but would not require additional straps on the mattress itself.

SUMMARY OF THE INVENTION

It is therefore a general object of the present invention to provide an improved mattress top assembly which may be attached and detached from a mattress.

A further object is to provide a mattress top assembly which eliminates the need for straps on a mattress.

Yet another object of the present invention is to provide a mattress top assembly which is simple to use, economical to manufacture, and refined in appearance.

These and other objects of the present invention will be apparent to those skilled in the art.

The mattress top assembly for a mattress of the present invention includes a pad filled with cushioning material and a plurality of connector straps attached along the head, foot, and side edges of the pad and removably connected to the side wall of the mattress. The mattress includes one part of a cooperable fastener generally midway between top and bottom surfaces, on the side walls of the mattress, for detachable connection of each of the straps thereto.

DESCRIPTION OF THE PREFERRED EMBODIMENT

Figure 1:
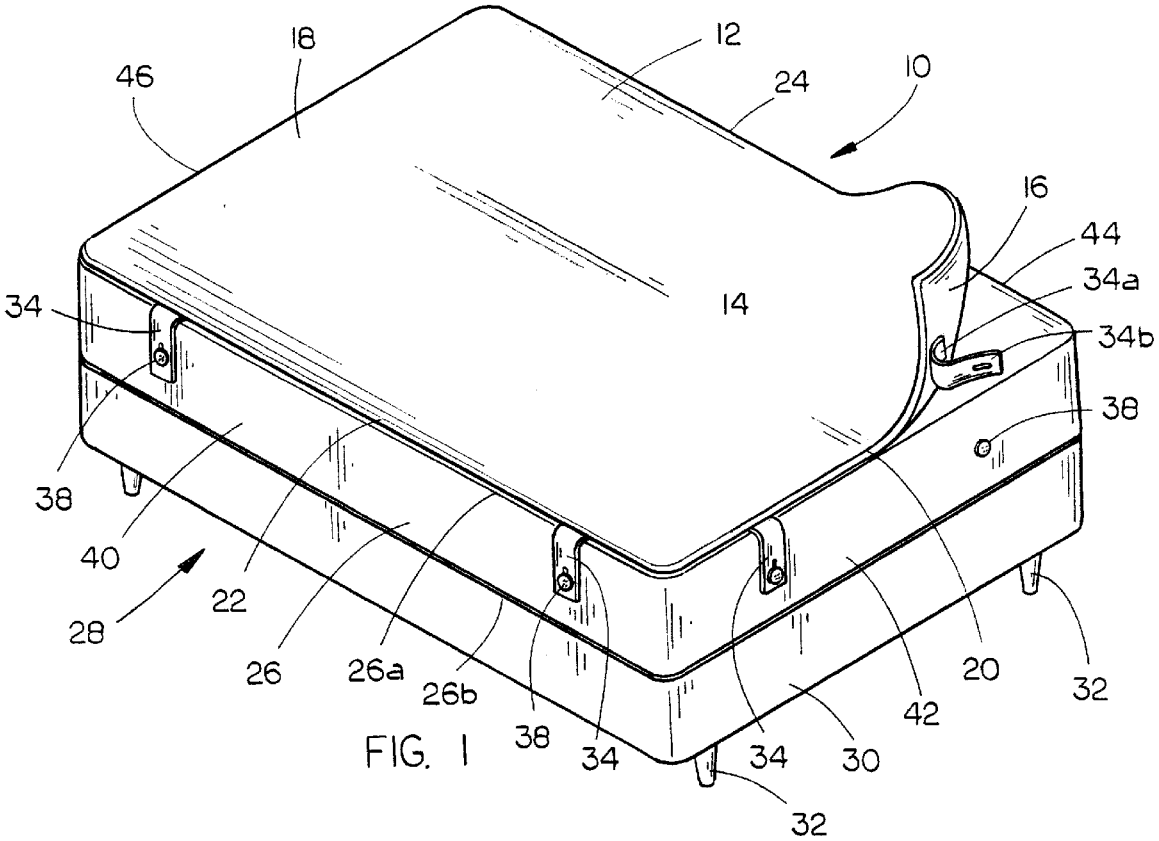
FIG. 1 is a perspective view of the mattress top assembly of the present invention attached to a mattress.

Referring now to the drawings, in which similar or corresponding parts are identified with the same reference numeral, and more particularly to FIG. 1, the mattress top assembly of the present invention is designated generally at 10 and includes a mattress top pad 12 having an upper surface 14 and lower surface 16, head and foot ends 18 and 20, and opposing side edges 22 and 24. Pad 12 contains cushioning and padding, to provide a soft and comfortable cushion for a mattress 26.

As shown in FIG. 1, mattress top assembly 10 is attached to a bed assembly 28, which includes a box spring 30 supported on a bed frame with feet 32, and mattress 26 atop box spring 30. As shown in FIG. 1, mattress 26 has a length and width substantially the same as box spring 30, and pad 12 has a length and width substantially the same as mattress 26.

Figure 2:
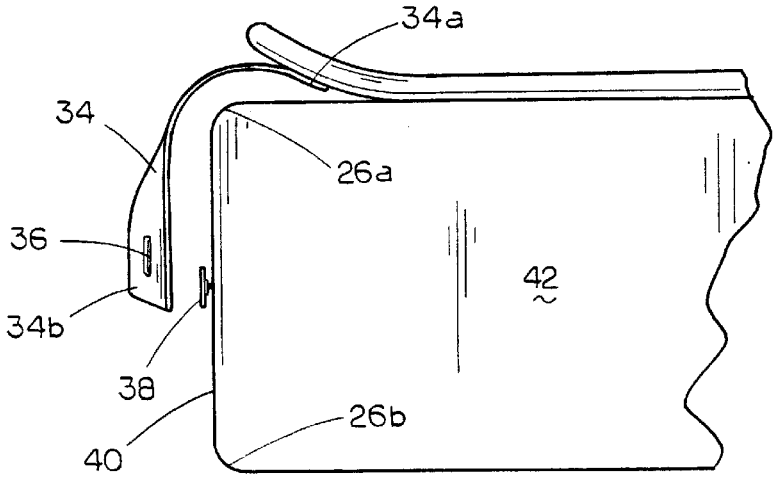
FIG. 2 is an end elevational view of a portion of a mattress with the mattress top assembly disconnected from the mattress.

A plurality of straps 34 are attached to the lower surface 16 of pad 12, and project outwardly therefrom along the head and foot ends 18 and 20, and side edges 22 and 24. Each strap 34 is formed of an elongated flexible strip of cloth, plastic, or other material, with one end 34*a* attached to the lower surface 16 of pad 12, and a free end 34*b* projecting outwardly therefrom, as shown in FIG. 2. In the preferred embodiment of the invention, the free end 34*b* of strap 34 has a buttonhole 36 formed therein for selective attachment to a button 38 on mattress 26.

As shown in FIG. 1, buttons 38 are mounted midway between the top and bottom edges 26*a* and 26*b* of mattress 26, and are located on each of the four side walls 40, 42, 44, and 46 of mattress 26, aligned with the location of straps 34.

Because buttons 38 are located midway between the top and bottom edges 26*a* and 26*b* of mattress 26, mattress top assembly 10 can be easily connected and disconnected from mattress 26, whether the mattress is inverted or not. The paid 12 is secured along its head and foot ends 18 and 20 and side edges 22 and 24, to prevent the mattress top assembly 10 from moving about on mattress 26 as the user rests thereon.

Figure 3:
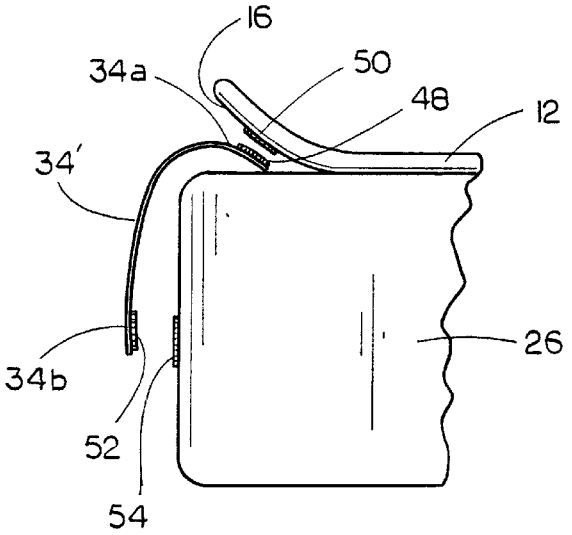
FIG. 3 is a view similar to FIG. 2, but showing a second embodiment of the invention.

Referring now to FIG. 3, a second embodiment of the mattress top assembly is disclosed, which utilizes the same pad 12, but a different connector strap 34'. Strap 34' preferably includes a removable fastener, such as a hook and loop fastener, at each end 34*a* and 34*b* thereof. Thus, a patch of hook fastener 48 is mounted on end 34*a* at strap 34', and is selectively attachable to loop fastener patch 50 on the lower surface 16 of pad 12. Similarly, a patch of hook fastener 52 is mounted on the free end 34b of strap 34', and may be removably secured to a patch of loop fastener 54 mounted on mattress 26, in place of the buttons 38 shown in FIGS. 1 and 2. The use of a strap 34' which is detachable at both ends permits quick and easy interchangeable attachment with different mattress top pads 12 in different mattresses 26. Obviously, other types of disconnectable fasteners may be utilized in place of the hook and loop fastener patches 48, 50, 52, and 54.

Figure 5:
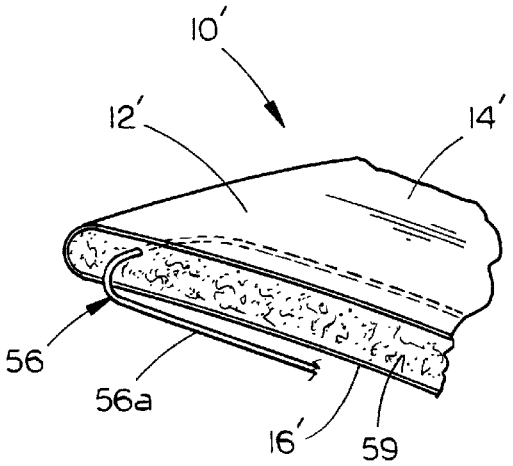
FIG. 5 is an enlarged sectional view through a portion of the mattress top shown in FIG. 4.
Figure 4:
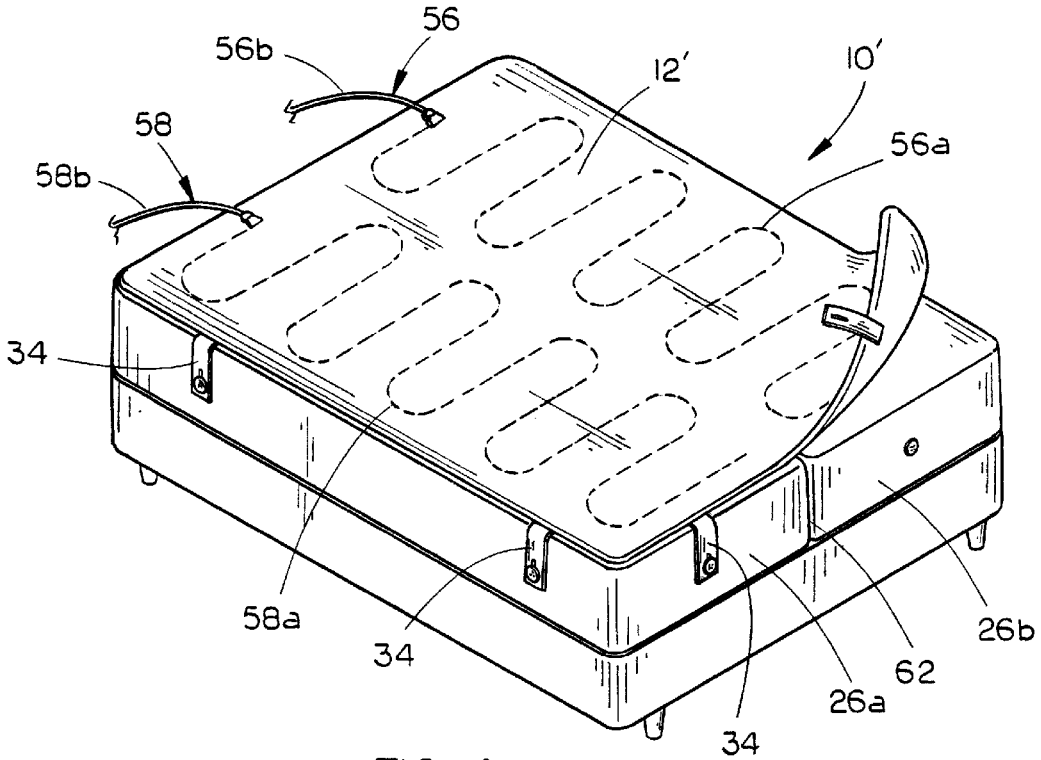
FIG. 4 is a perspective view of a third embodiment of the invention, with apparatus for heating the pillow top therein.

Referring now to FIGS. 4 and 5, a third embodiment of the mattress top assembly is disclosed, and identified generally at 10'. Pillow top assembly 10' utilizes the same fastener straps 34 as those disclosed in the first embodiment of the invention. However, pad 12' differs in the fact that it is heated, using a pair of heating devices 56 and 58. Two heating devices 56 and 58 are shown in the embodiment of FIG. 4, because the pad 12' is of a size for two persons. A single heating device would be used for a pad of a size for only a single user.

Heating devices 56 and 58 are of a conventional variety, using a heated electrical wire 56*a* and 58*a*, respectively imbedded within pad 12' and electrically connected to a power source via cords 56*b* and 58*b* respectively. Obviously, various conventional thermostats and other electronic controls may be utilized with the heating devices 56 and 58.

The addition of a heating device 56 to pad 12' has several advantages over conventional electric blankets. First, the heat is located under the user, between the insulating mattress and the user. Thus, the heating device is more efficient, because the heat does not dissipate into the surrounding air as occurs with an electric blanket. In addition, the sheets, blankets and other bedding can be changed without having to remove the heating device 56 from the bed. This makes bedding changes quicker and much simpler to accomplish.

The use of a heated mattress top pad 12' also has advantages over conventional mattress pads. First, mattress top pad 12' makes use of all of the advantages of a conventional mattress pad, but it superior to the mattress pad because it is thicker, with a greater thermal mass. This greater thermal mass also spaces the heating wires farther away from the bed occupant and more uniformly distributes the heat through the cushion material 59 forming the thermal mass of the mattress pad 12'. As shown in FIG. 5, heating wire 56*a* is preferably located generally centrally between the upper and lower surfaces 14' and 16' of mattress top pad 12'.

Pillow top pad 12' of mattress top assembly 10' is also superior to conventional mattress pads and electric blankets in view of the thicker more substantial cushion material 60 used therein. Thus, pad 12' has a greater thermal mass which stabilizes heat and temperature distribution throughout the pad. It also resists bunching and folding to reduce the chance of overlap or other causes of hot spots. The thickness of the pad also increases the likelihood that the pad will remain in place on the bed, especially in view of the use of connector straps 34.

Because of the substantial cushioning material within the mattress top pad 112', the mattress top assembly 10' may be utilized across a pair of mattresses 26*a* and 26*b*, as shown in FIG. 4. The use of two mattresses is more common on king size beds, and the use of mattress top pad 12' provides an effective bridge over the joint 62 between mattresses 26*a* and 26*b*. Conventional mattress pads are not capable of effective use in this manner, because of the thinness of the mattress pad.

Figure 6:
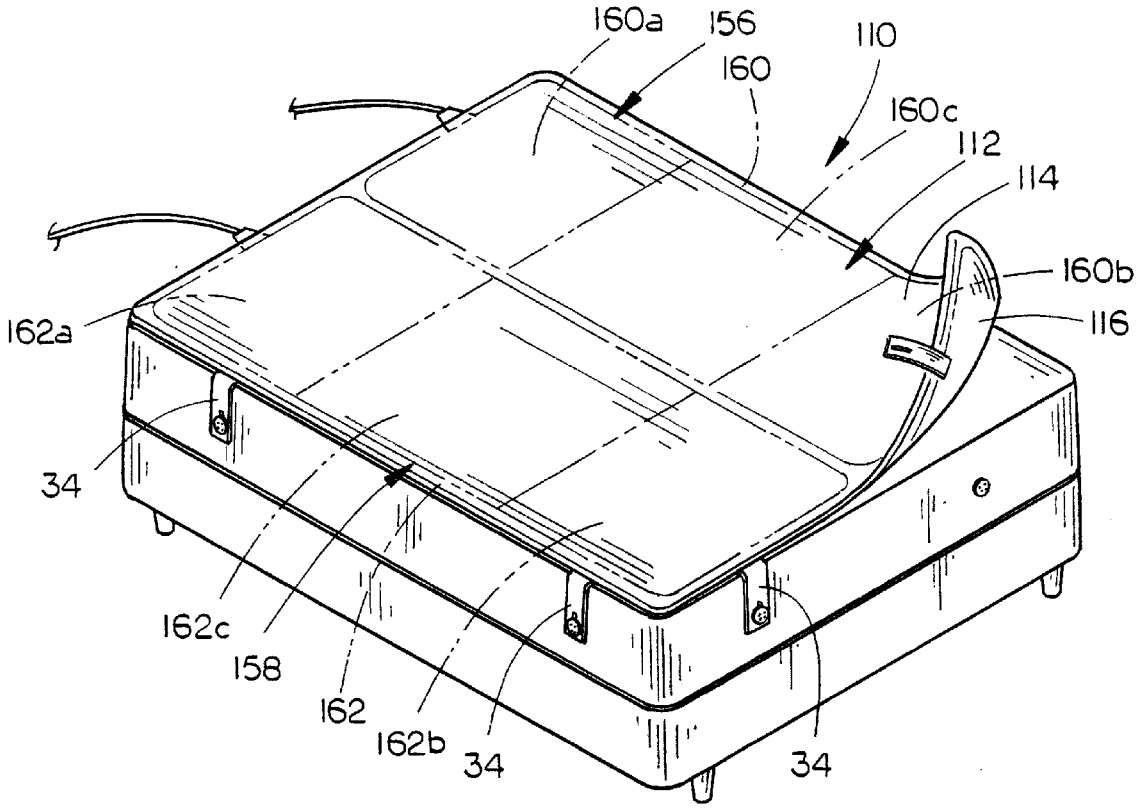
FIG. 6 is a perspective view of a fourth embodiment of the invention.
Figure 7:
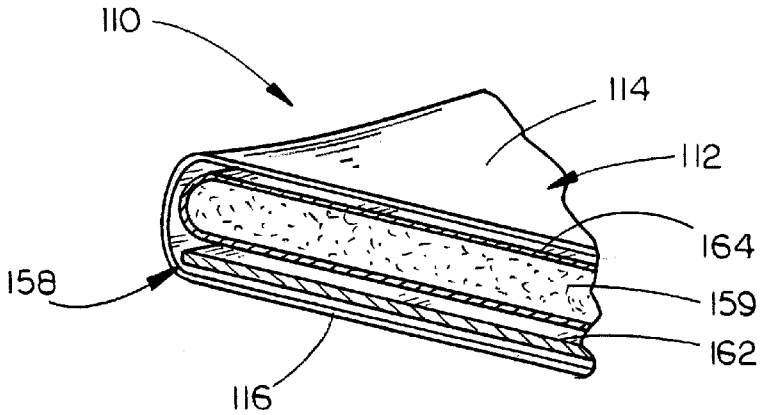
FIG. 7 is an enlarged sectional view through a portion of the mattress top shown in FIG. 6.

Referring now to FIGS. 6 and 7, a fourth embodiment of the mattress top assembly is disclosed and identified generally at 110. Mattress top assembly 110 uses the same fastener straps 34 as those disclosed in the first embodiment of the invention. However, pad 112 differs from the first embodiment in the use of a pair of heating devices 156 and 158. Two heating devices 156 and 158 are shown in the embodiment of FIG. 6, because the pad 112 is of a size for two persons. A single heating device would be used for a pad of a size for only a single user.

Heating devices 156 and 158 may be of any conventional type. In FIGS. 6 and 7, heating devices 156 and 158 are formed of solid resistance wires or etched aluminum resistance elements which have been embedded or imprinted in a flat flexible mylar mat and sealed in a protective PVC sheet 160 and 162, respectively. Each sheet 160 and 162 includes three independently controlled heating zones: (1) a head heating zone 160*a* and 162*a*, (2) a foot heating zone 160*b* and 162*b*, and (3) a mid-body heating zone 160*c* and 162*c*, respectively.

As with the embodiment of FIGS. 4 and 5, the attachment of heating devices 156 and 158 to pad 112 has several advantages over conventional electric blankets. The pad 112 of FIGS. 6 and 7 differs from the heated pad 12' of FIGS. 4 and 5 in the use of a removable heating device 156 and 158. As shown in FIG. 7, cushion material 159 is within a case 164. Heating device 158 is supported within pad 112 with case 164, between upper and lower surfaces 114 and 116. In this way, pad 112 may be opened to selectively remove heating device 156 and 158, to permit repair or replacement, or cleaning of pad 112 with the heating devices removed.

Whereas the invention has been shown and described in connection with the preferred embodiment thereof, many modifications, substitutions and additions may be made which are within the intended broad scope of the appended claims.

I claim:

1. A mattress top pad assembly for a mattress, comprising:

a mattress top pad having upper and lower surfaces, a head end, a foot end, and opposing side edges, said pad filled with cushioning material;

means for securing said pad to the mattress; and a heating means including a heating element formed within a generally planar sheet, said sheet being disposed within said pad, said sheet being adapted to be readily connected to and disconnected from said pad.

2. The pillow top assembly of claim 1 wherein said sheet includes a head end, a foot end, opposing side edges, and a plurality of independently controlled heat zones.

3. The pillow top assembly of claim 2 wherein said sheet includes a head heat zone at said head end of said sheet, a foot heat zone at said foot end of said sheet, and a mid-body heat zone between said head heat zone and said foot heat zone.

4. The pillow top assembly of claim 1 wherein said means for securing said pad to the mattress comprises a plurality of connector straps, each being attached at a first end thereof to either said head end, said foot end, or one of said side edges of said pad, and extending outwardly therefrom to a free second end, said second end having means connected thereto for detachably connecting said second end to the mattress.

5. In combination:

a mattress having a top, a bottom, and a side wall extending between the top and bottom and continuously around head and foot ends and opposing side edges of the top and bottom; and a mattress top pad detachably connected to the mattress and extending over and resting on the mattress top;

said mattress top pad further including a heating means having a heating element formed within a generally planar sheet, said sheet being disposed within said pad and being adapted to be readily connected to and disconnected from said pad.

6. A bed assembly, comprising:

first and second mattresses, each having a top and bottom, opposing first and second side walls, a head end wall, and a foot end wall, said mattresses being equal in size and thickness and arranged with the first side wall of the first mattress adjacent to the first side wall of the second mattress to form a single top surface and provide nonadjacent second side walls of each mattress;

a mattress top pad detachably connected to said head end walls, said foot end walls, and said nonadjacent second side walls of each mattress, and extending over and resting on said top surface formed by the mattresses; and said pad further including a heating means having a heating element formed within a generally planar sheet, said sheet being disposed within said pad and being adapted to be readily connected to and disconnected from said pad.

7. The bed assembly of claim 6 wherein said heating means includes a first heating element removably connected to said pad and positioned generally coextensive with said top of said first mattress, and a second heating element removably connected to said pad and positioned generally coextensive with said top of said second mattress, said second heating element operable independently of said first heating element.

* * * * *